US009513580B2

(12) United States Patent
Imanaka

(10) Patent No.: US 9,513,580 B2
(45) Date of Patent: Dec. 6, 2016

(54) IMAGE FORMING APPARATUS WITH FALL PATH OF DEVELOPER

(71) Applicant: KYOCERA Document Solutions Inc., Osaka-shi, Osaka (JP)

(72) Inventor: Koichi Imanaka, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/971,812

(22) Filed: Dec. 16, 2015

(65) Prior Publication Data

US 2016/0179034 A1 Jun. 23, 2016

(30) Foreign Application Priority Data

Dec. 22, 2014 (JP) ..... 2014-259039

(51) Int. Cl.
*G03G 15/095* (2006.01)
*G03G 21/10* (2006.01)

(52) U.S. Cl.
CPC ..... *G03G 15/095* (2013.01); *G03G 21/105* (2013.01)

(58) Field of Classification Search
CPC ..... G03G 15/0877; G03G 15/0879; G03G 15/095; G03G 21/10; G03G 21/105
See application file for complete search history.

(56) References Cited

U.S. PATENT DOCUMENTS

2009/0257798 A1* 10/2009 Hoshino ..... G03G 21/105 399/358

FOREIGN PATENT DOCUMENTS

JP 2009122362 A 6/2009

* cited by examiner

*Primary Examiner* — Sandra Brase
(74) *Attorney, Agent, or Firm* — Alleman Hall McCoy Russell & Tuttle LLP

(57) ABSTRACT

An image forming apparatus includes: a displacement member supported so as to be displaceable; and a drive mechanism. The drive mechanism is a mechanism configured to displace the displacement member between a first position away from a fall path of a movement path for a powdery developer and a second position at which at least a part of the displacement member enters the fall path.

12 Claims, 7 Drawing Sheets

IMAGE FORMING APPARATUS WITH FALL PATH OF DEVELOPER

INCORPORATION BY REFERENCE

This application is based upon and claims the benefit of priority from the corresponding Japanese Patent Application No. 2014-259039 filed on Dec. 22, 2014, the entire contents of which are incorporated herein by reference.

BACKGROUND

The present disclosure relates to an image forming apparatus which forms an image by using a powdery developer.

In general, in an electrophotographic type image forming apparatus, an image is formed by using a powdery developer including toner. The developer is conveyed by a conveying portion, such as a screw type conveying portion, along a movement path formed within a casing. At this time, the developer that has not been used is conveyed from a developer supply portion to an image forming portion, and further the developer that has been used is conveyed from the image forming portion to a waste developer storage portion.

In addition, a part of the movement path for the developer may be a fall path. The fall path is a path in which the developer falls due to its own weight. The fall path includes one of or both an inclined slide path on an inclined surface and a vertical fall path formed along the vertical direction.

When the flowability of the developer decreases due to mechanical stress or mixing of impurities such as paper powder and the like, the developer easily adheres to a wall surface of the movement path. Adhesion of the developer easily occurs on a wall surface of the fall path. If the developer adheres to the wall surface of the movement path, the movement path becomes clogged, resulting in various kinds of inconvenience.

In the image forming apparatus, it is known that a spring-shaped conveying member disposed at a connection portion between two conveyance paths reciprocates while rotating, thereby preventing clogging with the developer.

SUMMARY

An image forming apparatus according to one aspect of the present disclosure includes a displacement member and a drive mechanism. The displacement member is a member supported so as to be displaceable. The drive mechanism is a mechanism configured to displace the displacement member between a first position away from a fall path of a movement path for a powdery developer and a second position at which at least a part of the displacement member enters the fall path. The fall path includes an inclined slide path on an inclined surface and a vertical fall path which is connected to a lower portion of the inclined slide path and formed along a vertical direction. The drive mechanism displaces the displacement member between the first position and the second position at which a part of the displacement member is located in a range from the inclined slide path to the vertical fall path.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
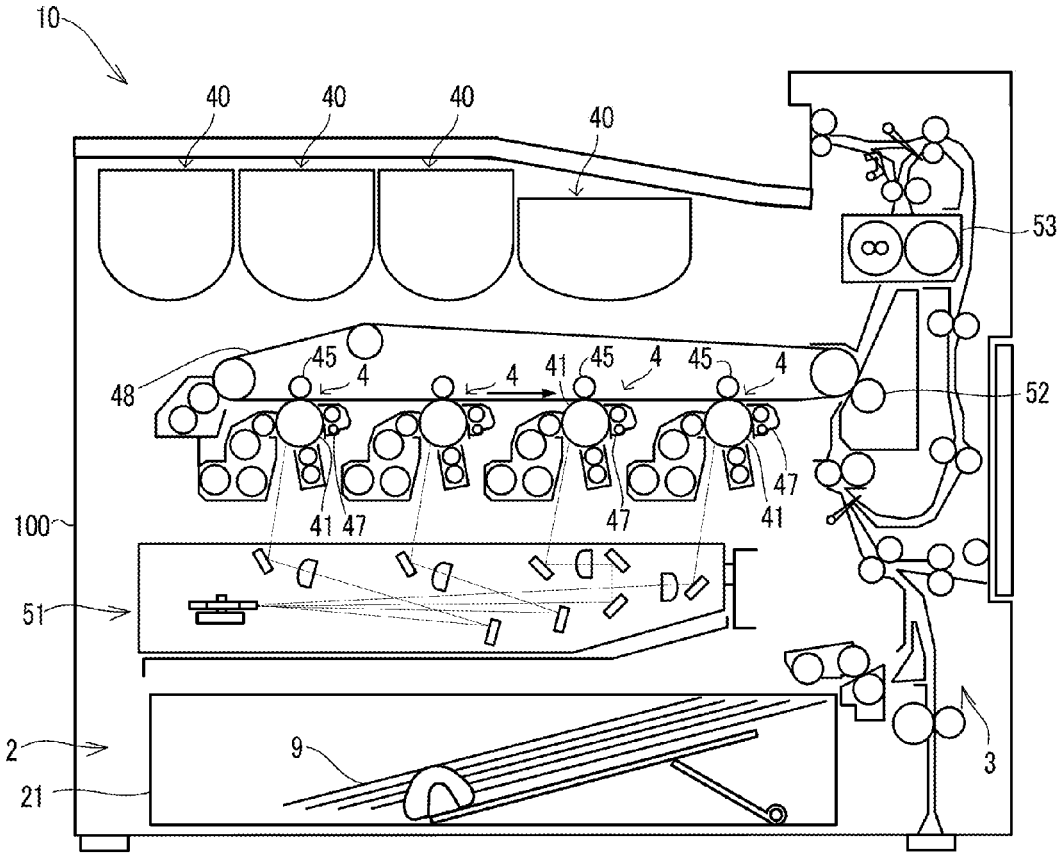
FIG. 1 is a configuration diagram of an image forming apparatus according to an embodiment.

Hereinafter, embodiments of the present disclosure will be described with reference to the accompanying drawings. The following embodiments are examples embodying the present disclosure and do not have nature of limiting the technical scope of the present disclosure.

[Configuration of Image Forming Apparatus 10]

Hereinafter, an image forming apparatus 10 according to an embodiment will be described. The image forming apparatus 10 is an electrophotographic type image forming apparatus which forms an image by using powdery developers 90. Each developer 90 includes toner.

The image forming apparatus 10 includes, within a housing 100, a sheet feed portion 2, a sheet conveying portion 3, a plurality of developer supply portions 40, a plurality of image forming portions 4, an optical scanning portion 51, a secondary transfer portion 52, a fixing portion 53, and an intermediate transfer belt 48, etc.

The sheet feed portion 2 sends out, to the image forming portions 4, a recording sheet 9 housed in a sheet cassette 21 which is detachably mounted to the housing 100.

The image forming portions 4 each include a drum-shaped photosensitive member 41, a primary transfer portion 45, and a primary cleaning portion 47, etc. The photosensitive member 41 is an example of an image carrier.

The primary cleaning portion 47 cleans the surface of the photosensitive member 41 by removing the developer 90 remaining on the surface of the photosensitive member 41. In the following description, the developer 90 removed from the surface of the photosensitive member 41, that is, the developer 90 that has been used, is referred to as waste developer 900.

Figure 2:
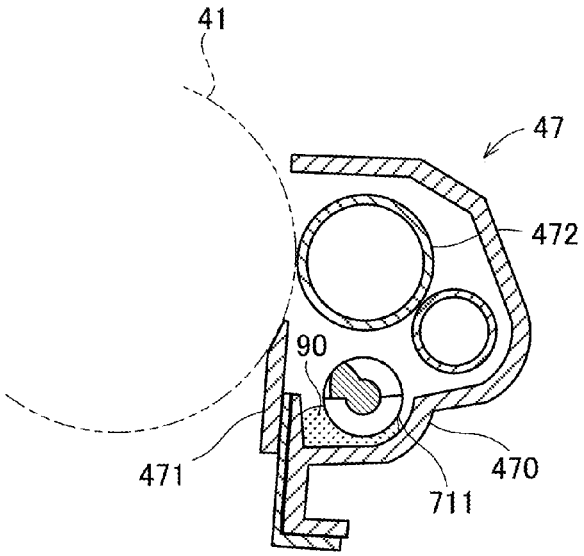
FIG. 2 is a schematic cross-sectional view of a primary cleaning portion included in the image forming apparatus according to the embodiment.

In the example shown in FIG. 2, the primary cleaning portion 47 includes: a cleaning blade 471 and a cleaning roller 472 which remove the developer 90 from the surface of the photosensitive member 41; and a waste developer receiving portion 470. In FIG. 2, the photosensitive member 41 is shown by a virtual line (alternate long and two short dashes line).

The waste developer receiving portion 470 temporarily receives the waste developer 900 removed from the surface of the photosensitive member 41 by the cleaning blade 471 and the cleaning roller 472. The image forming apparatus 10 further includes a waste developer conveying mechanism 7 which conveys the waste developer 900 within the waste developer receiving portion 470 to a waste developer collection container 700. The waste developer collection container 700 is an example of the waste developer storage portion.

[Waste Developer Conveying Mechanism 7]

Hereinafter, the waste developer conveying mechanism 7 will be described with reference to FIGS. 3 to 6. The waste developer conveying mechanism 7 includes first casings 71, first lateral conveying members 711, and a waste developer discharge unit 70. The waste developer discharge unit 70 includes a second casing 72, a second lateral conveying member 721, an accumulated developer breaking mechanism 8, and the waste developer collection container 700.

Each first casing 71 is a portion which forms a conveyance path for the waste developer 900 along a lateral direction. For example, the first casing 71 is a tubular member supported along the lateral direction. The first lateral conveying member 711 is a member which conveys the waste developer 900 in the lateral direction by rotating within the conveyance path formed by the first casing 71.

The lateral direction includes a horizontal direction (just lateral direction), and a direction inclined slightly relative to the horizontal direction, for example, a direction (an obliquely lateral direction) that forms an acute angle of less than 45 degrees relative to the horizontal direction.

In the following description, the conveyance path for the waste developer 900 in the first casing 71 is referred to as first lateral conveyance path 710. The first casing 71 houses the first lateral conveying member 711 disposed in the first lateral conveyance path 710. In addition, a direction in which the first lateral conveying member 711 conveys the waste developer 900 is referred to as first lateral direction R1.

For example, each first lateral conveying member 711 is a conveyance screw which includes a rotation shaft portion and a blade portion formed helically on the rotation shaft portion. The first lateral conveying member 711 may be a coil-shaped member.

The first lateral conveyance path 710 is in communication with the interior of the waste developer receiving portion 470 of the primary cleaning portion 47. In addition, the first lateral conveying member 711 is formed so as to extend along the first lateral direction R1 from the interior of the waste developer receiving portion 470 to the first lateral conveyance path 710. In this case, the first lateral direction R1 is a direction parallel to a rotation center line of the photosensitive member 41, and is a so-called main-scanning direction.

The first casing 71 has a lower opening 712 which is formed near an end thereof at the downstream side in the first lateral direction R1 and which serves as an outlet for the waste developer 900 toward the lower side.

Therefore, when the first lateral conveying member 711 rotates, the waste developer 900 is conveyed from the interior of the waste developer receiving portion 470 to the first lateral conveyance path 710, is further conveyed in the first lateral conveyance path 710 along the first lateral direction R1, and then falls through the lower opening 712.

The waste developer discharge unit 70 is an assembly of components for conveying, to the interior of the waste developer collection container 700, the waste developer 900 falling through the lower opening 712 of each of a plurality of the first casings 71.

The second casing 72 of the waste developer discharge unit 70 is a member which forms therein a movement path in a lateral direction through which the waste developer 900 falling through the lower opening 712 of each of the plurality of the first casings 71 passes. Therefore, the second casing 72 has a plurality of upper openings 725 which are formed in communication with the lower openings 712 of the first casings 71, respectively.

Each first casing 71 and the second casing 72 form a movement path for the developer 90 which includes a fall path 722 described later. The movement path according to the present embodiment is a path which extends from each image forming portion 4, which forms an image by using the developer 90, to the waste developer collection container 700 and in which the waste developer 900 moves.

In the following description, the movement path for the waste developer 900 which movement path is formed by the second casing 72 therein is referred to as second lateral conveyance path 720. The second casing 72 houses the second lateral conveying member 721 disposed in the second lateral conveyance path 720. A direction in which the second lateral conveying member 721 conveys the waste developer 900 is referred to as second lateral direction R2.

The second casing 72 includes a first resin member 72*a* and a second resin member 72*b* which are combined with each other. The second lateral conveying member 721 is a member which conveys the waste developer 900 in the lateral direction by rotating within the conveyance path formed by the second casing 72.

For example, the second lateral conveying member 721 is a conveyance screw which includes a rotation shaft portion and a blade portion formed helically on the rotation shaft portion. The second lateral conveying member 721 may be a coil-shaped member.

The image forming apparatus 10 further includes a driving source such as a motor which is not shown. Each first lateral conveying member 711 and the second lateral conveying member 721 are rotationally driven by the driving source and a gear mechanism or the like which operates in conjunction with motion of the driving source.

Figure 3:
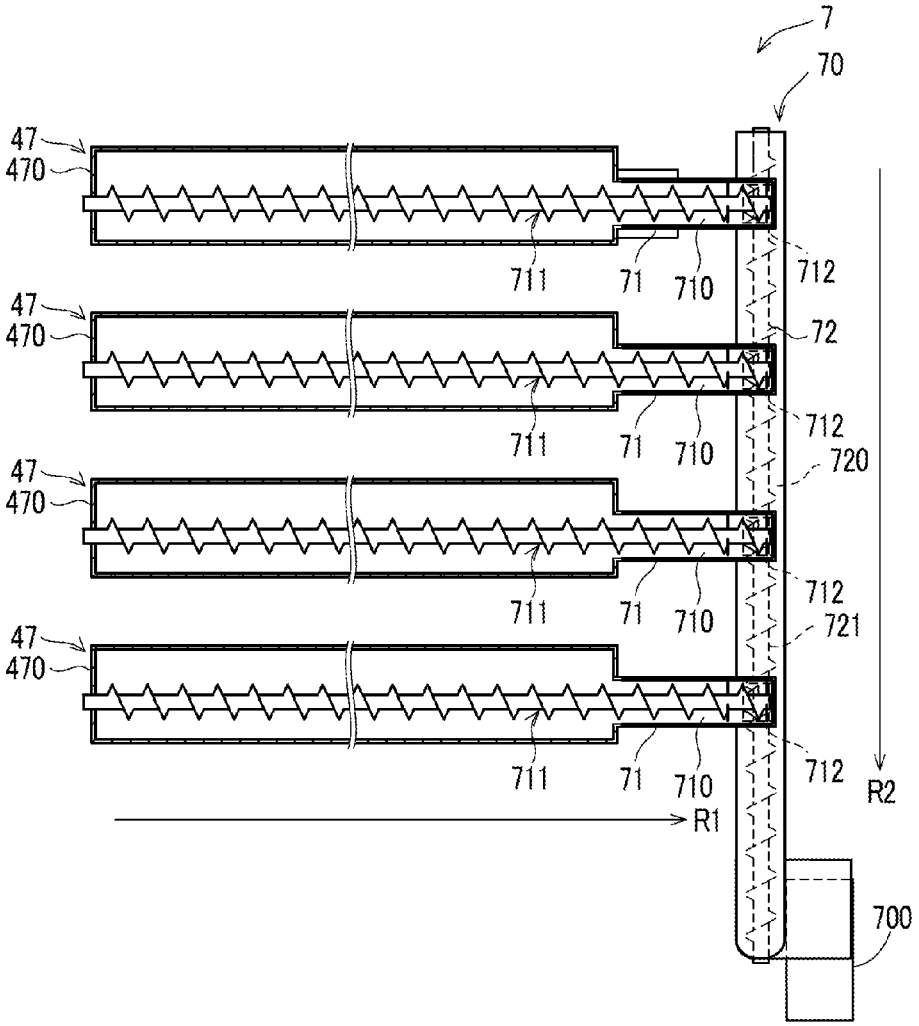
FIG. 3 is a partially cutaway schematic plan view of a developer conveying mechanism included in the image forming apparatus according to the embodiment.
Figure 4:
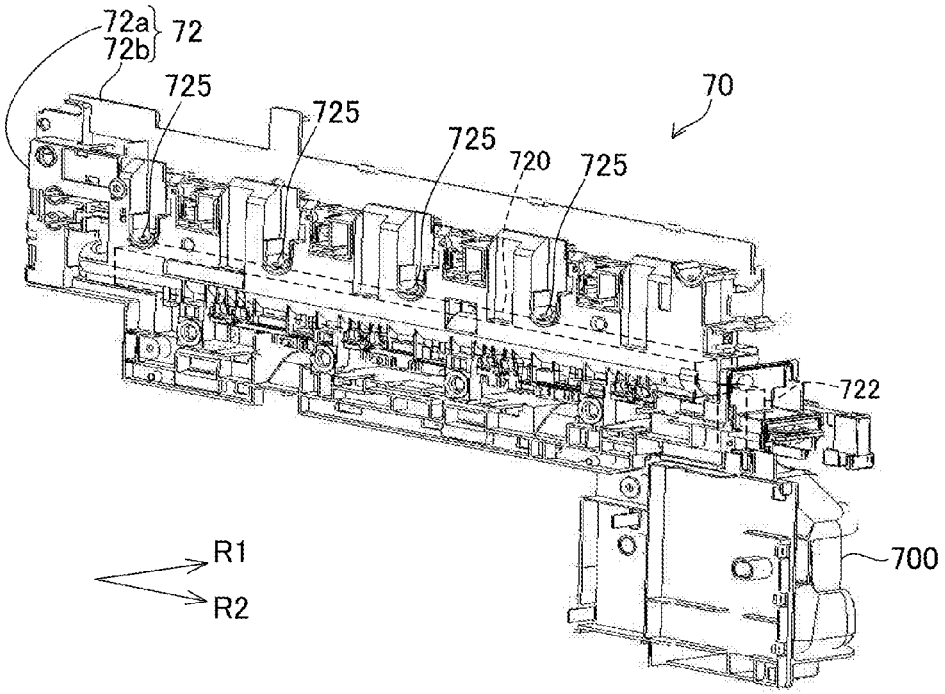
FIG. 4 is a perspective view of a waste developer discharge unit included in the image forming apparatus according to the embodiment.
Figure 5:
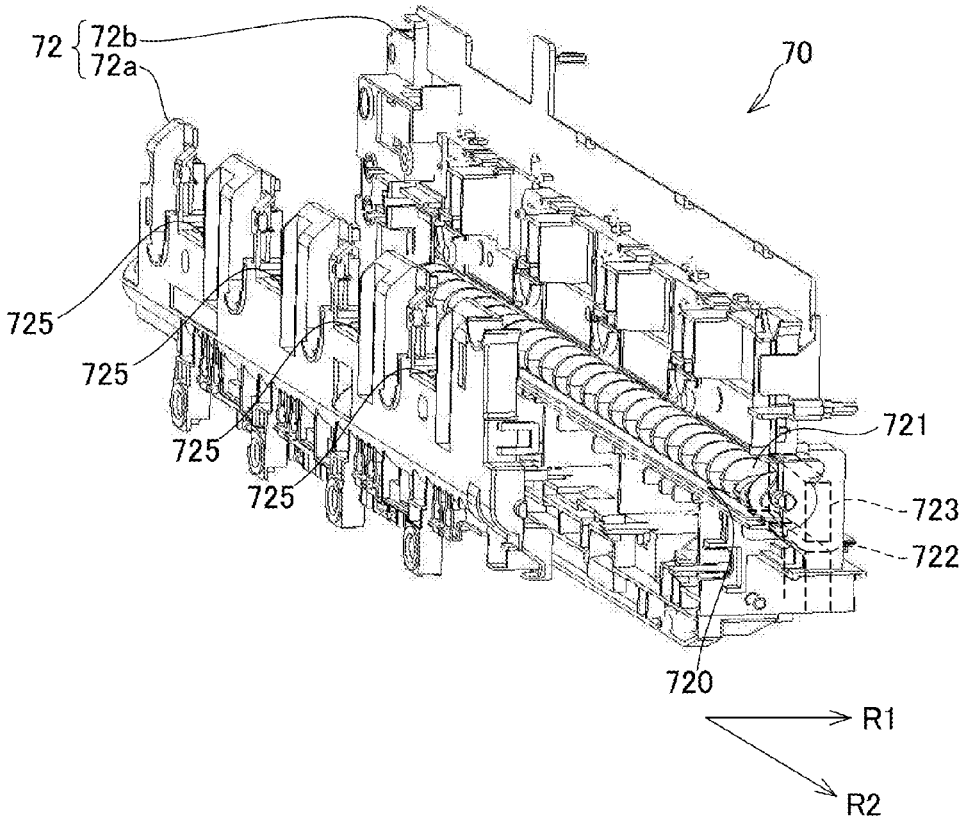
FIG. 5 is an exploded perspective view of the waste developer discharge unit included in the image forming apparatus according to the embodiment.
Figure 6:
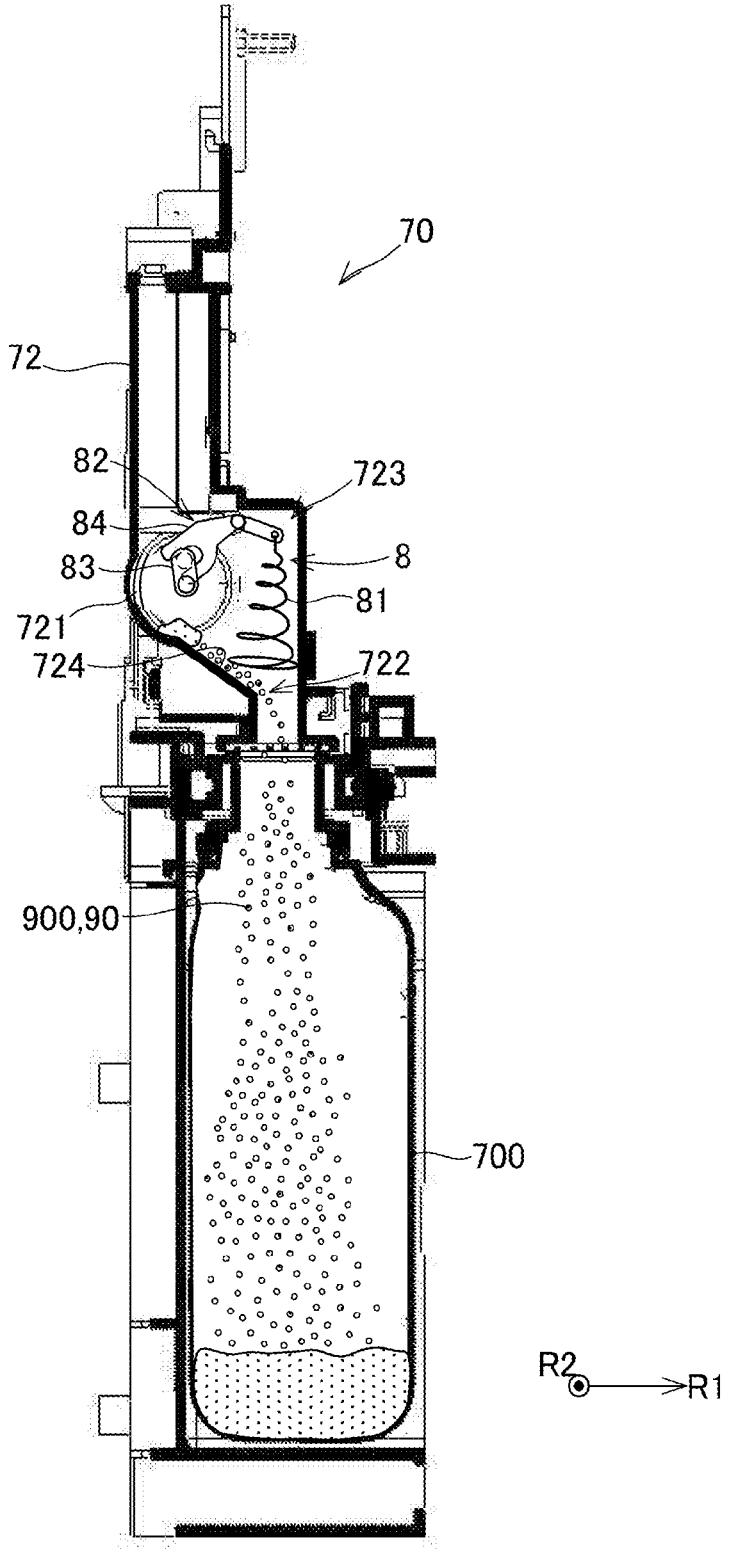
FIG. 6 is a longitudinal cross-sectional view of a waste developer collection container and a peripheral area thereof in the waste developer discharge unit included in the image forming apparatus according to the embodiment.

As shown in FIG. 3, the image forming apparatus 10 includes the plurality of the first casings 71 and a plurality of the first lateral conveying members 711 of which the number is the same as the number of the first casings 71. The first casing 71 and the first lateral conveying member 711 are provided for each image forming portion 4, that is, for each color of the developer 90.

Meanwhile, the second casing 72 and the second lateral conveying member 721 are common portions for the plurality of the first casings 71 and the plurality of the first lateral conveying members 711. The plurality of the first casings 71 are arranged so as to be spaced apart from each other in the second lateral direction R2.

The fall path 722 is formed at a stage subsequent to the second lateral conveyance path 720. The second lateral conveyance path 720 is an example of a lateral movement path which is connected to the upper portion of the fall path 722 of the movement path for the waste developer 900 and formed along the lateral direction. The second lateral conveying member 721 conveys the waste developer 900 in the lateral direction by rotating within the second lateral conveyance path 720.

The waste developer 900 that has fallen to the second lateral conveyance path 720 is conveyed within the second lateral conveyance path 720 in the second lateral direction R2 by the rotating second lateral conveying member 721. Furthermore, after the waste developer 900 is conveyed to the vicinity of the end of the second lateral conveyance path 720 at the downstream side in the second lateral direction R2, the waste developer 900 falls through the fall path 722, which is formed in the second casing 72, to the interior of the waste developer collection container 700. Accordingly, the used waste developers 900 of all colors are collected within the waste developer collection container 700.

The fall path 722 is a part of the movement path for the developer 90, and is a path in which the powdery waste developer 900 falls due to its own weight. The movement path for the developer 90 according to the present embodiment includes the first lateral conveyance paths 710, the second lateral conveyance path 720, and the fall path 722. In each first lateral conveyance path 710 and the second lateral conveyance path 720, the waste developer 900 moves by being conveyed by the rotating lateral conveying members 711 and 721.

When the flowability of the developer 90 decreases due to mechanical stress or mixing of impurities such as paper powder and the like, the developer 90 easily adheres to a wall surface of the movement path. The waste developer 900 particularly easily adheres to the wall surface since the waste developer 900 is subject to mechanical stress from the cleaning blade 471, the cleaning roller 472, and the like.

Adhesion of the waste developer 900 easily occurs on a wall surface of the fall path 722. If the developer 90 such as the waste developer 900 adheres to the wall surface of the movement path, the movement path becomes clogged, resulting in various kinds of inconvenience.

Meanwhile, in the image forming apparatus 10, a rotary conveying member cannot be provided within the fall path 722 in some cases. In these cases, it is difficult to prevent clogging of the fall path 722 with the waste developer 900.

The image forming apparatus 10 has a structure which can prevent clogging, with the waste developer 900, of the fall path 722 of the movement path for the developer 90 without providing a rotary conveying member in the fall path 722. That is, the waste developer discharge unit 70 of the image forming apparatus 10 includes the accumulated developer breaking mechanism 8 for preventing clogging with the waste developer 900.

[Accumulated Developer Breaking Mechanism 8]

Hereinafter, the accumulated developer breaking mechanism 8 will be described with reference to FIGS. 7 to 10. The accumulated developer breaking mechanism 8 is a mechanism which breaks the accumulated waste developer 900 in the fall path 722.

The fall path 722 includes an inclined slide path 7221 on an inclined surface 724. The inclined surface 724 is a part of a wall surface formed in the second casing 72 so as to surround the fall path 722.

In the inclined slide path 7221, the waste developer 900 slides down on the inclined surface 724. The fall path 722 according to the present embodiment also includes a vertical fall path 7222 in addition to the inclined slide path 7221. The vertical fall path 7222 is connected to the lower side of the inclined slide path 7221 and formed along the vertical direction.

The waste developer 900 slides down on the inclined surface 724 along the inclined slide path 7221 in an obliquely downward direction R3, and then falls along the vertical fall path 7222 in a vertically downward direction R4.

The accumulated developer breaking mechanism 8 includes: a displacement member 81 which is supported so as to be displaceable; and a drive mechanism 82 which displaces the displacement member 81. The displacement member 81 is a member of which a part can come into contact with the accumulated waste developer 900.

The displacement member 81 according to the present embodiment includes a supported portion 811 and a helical portion 812. The supported portion 811 is a portion which is supported by a support portion 8430 of the drive mechanism 82. The helical portion 812 is a portion which is formed in a helical shape and is elastically deformable. The supported portion 811 is supported by the support portion 8430 of the drive mechanism 82. The helical portion 812 is formed so as to be connected to the supported portion 811.

The displacement member 81 is supported by the support portion 8430 of the drive mechanism 82 in a suspended state. The supported portion 811 of the displacement member 81 is connected to the support portion 8430. Furthermore, the displacement member 81 includes a large-diameter portion 8120 which is formed at a lower end with a larger contour than the upper supported portion 811 supported by the support portion 8430.

The large-diameter portion 8120 according to the present embodiment is an end portion of the helical portion 812 at a side opposite to the supported portion 811. In the example shown in FIGS. 6 to 10, the helical portion 812 is formed in a helical shape in which the contour is gradually increased in size from the supported portion 811 side toward the side opposite to the supported portion 811.

Figure 9:
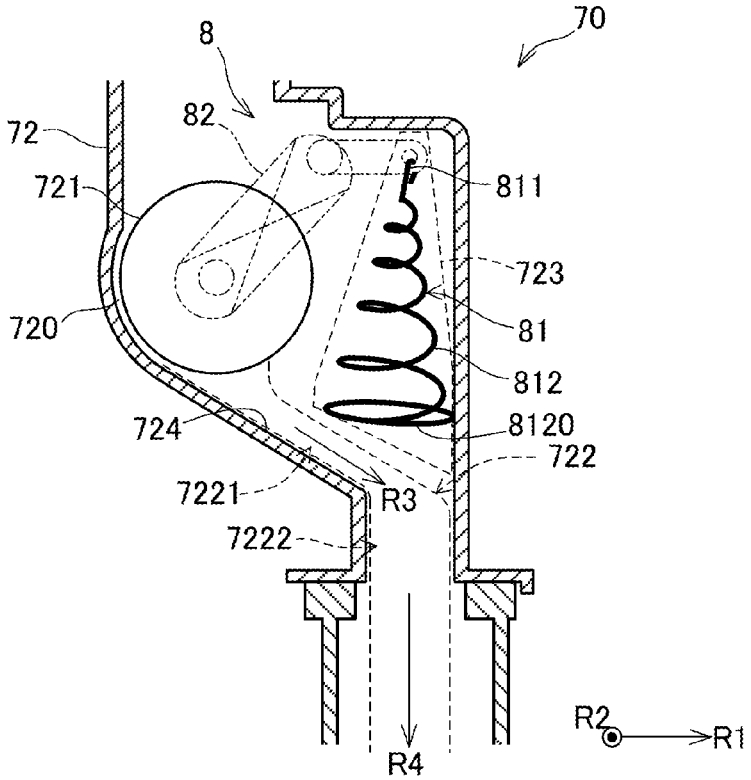
FIG. 9 is a first schematic lateral cross-sectional view of the accumulated developer breaking mechanism part in the waste developer discharge unit included in the image forming apparatus according to the embodiment.
Figure 10:
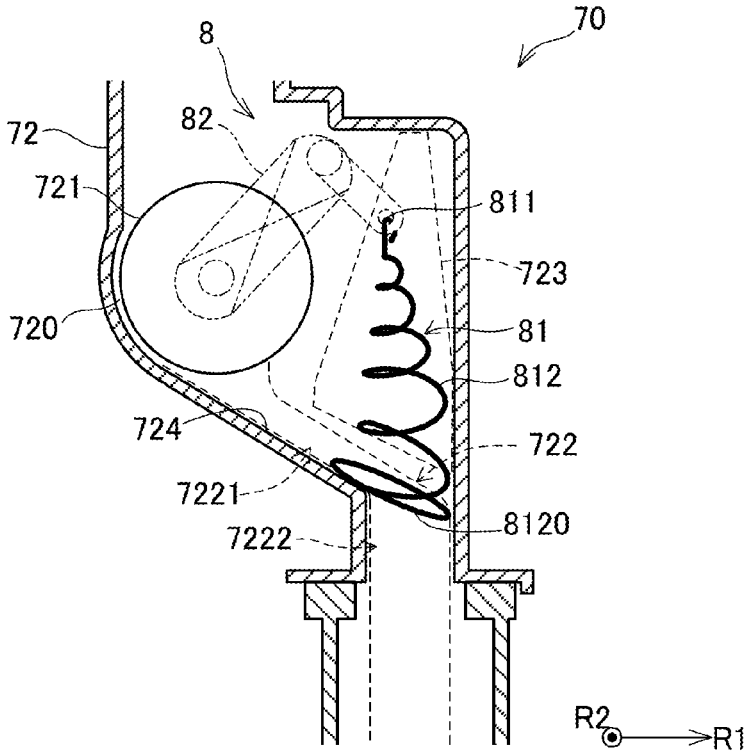
FIG. 10 is a second schematic lateral cross-sectional view of the accumulated developer breaking mechanism part in the waste developer discharge unit included in the image forming apparatus according to the embodiment.

The drive mechanism 82 is a mechanism which displaces the displacement member 81 between a first position away from the fall path 722 and a second position at which a part of the displacement member 81 enters the fall path 722. FIG. 9 shows a state where the displacement member 81 is located at the first position, and FIG. 10 shows a state where the displacement member 81 is located at the second position lower than the first position. In FIGS. 9 and 10, the drive mechanism 82 is simplified and represented by virtual lines (alternate long and two short dashes lines).

As shown in FIGS. 9 and 10, in the state where the displacement member 81 is located at the first position, the entire displacement member 81 is located above the fall path 722. That is, the displacement member 81 located at the first position is contained within a retreat space 723 formed in the second casing 72 and above the fall path 722.

In addition, in the state where the displacement member 81 is located at the second position, the large-diameter portion 8120 of the displacement member 81 is located within the fall path 722. The large-diameter portion 8120 is a lower end portion of the displacement member 81.

In the present embodiment, a portion of the displacement member 81 that enters the fall path 722 is the large-diameter portion 8120, and the other portion of the displacement member 81 is formed with a smaller contour than the large-diameter portion 8120. Thus, the retreat space 723 above the fall path 722 is sufficient if it is a relatively small space.

Since the displacement member 81 constantly retreats to the first position, the waste developer 900 is unlikely to be accumulated on the displacement member 81. Furthermore, since the displacement member 81 is constantly displaced to the second position, the accumulated waste developer 900 in the fall path 722 is broken by being brought into contact with the displacement member 81 at a stage where the accumulated waste developer 900 is relatively small in size.

Therefore, when the image forming apparatus 10 is adopted, clogging of the fall path 722 with the waste developer 900 can be prevented without providing a rotary conveying member in the fall path 722 for the waste developer 900.

In the example shown in FIG. 10, in the state where the displacement member 81 is located at the second position, the large-diameter portion 8120 is located in a range from the inclined slide path 7221 to the vertical fall path 7222. That is, the drive mechanism 82 displaces the displacement member 81 between the first position and the second position at which the large-diameter portion 8120 is located in the range from the inclined slide path 7221 to the vertical fall path 7222.

Therefore, the accumulated developer breaking mechanism 8 can prevent clogging of both the inclined slide path 7221 and the vertical fall path 7222 with the waste developer 900.

As shown in FIG. 10, in the state where the displacement member 81 supported in the suspended state is located at the second position, the large-diameter portion 8120 of the displacement member 81 is located in an inclined state in the range from the inclined slide path 7221 to the vertical fall path 7222. Thus, the large-diameter portion 8120 reaches the inclined slide path 7221 and the vertical fall path 7222 which is below the inclined slide path 7221, thereby enabling the accumulated waste developer 900 to be broken more effectively.

When the displacement member 81 is displaced to the second position, the displacement member 81 is sandwiched between the support portion 8430 and the inclined surface 724, whereby the helical portion 812 contracts. Thus, the displacement member 81 can break the accumulated waste developer 900 within the fall path 722 with a strong force, and a sound generated by the displacement member 81 and the inclined surface 724 coming into contact with each other is reduced.

Since the helical portion 812 deforms constantly, if the waste developer 900 adheres to the helical portion 812, the waste developer 900 falls off from the helical portion 812.

The drive mechanism 82 according to the present embodiment is a link mechanism which converts a rotating motion of the second lateral conveying member 721 to a reciprocating motion of the support portion 8430 connected to the displacement member 81. Thus, it is not necessary to provide a special driving source for the drive mechanism 82, and the structure can be simplified.

Figure 7:
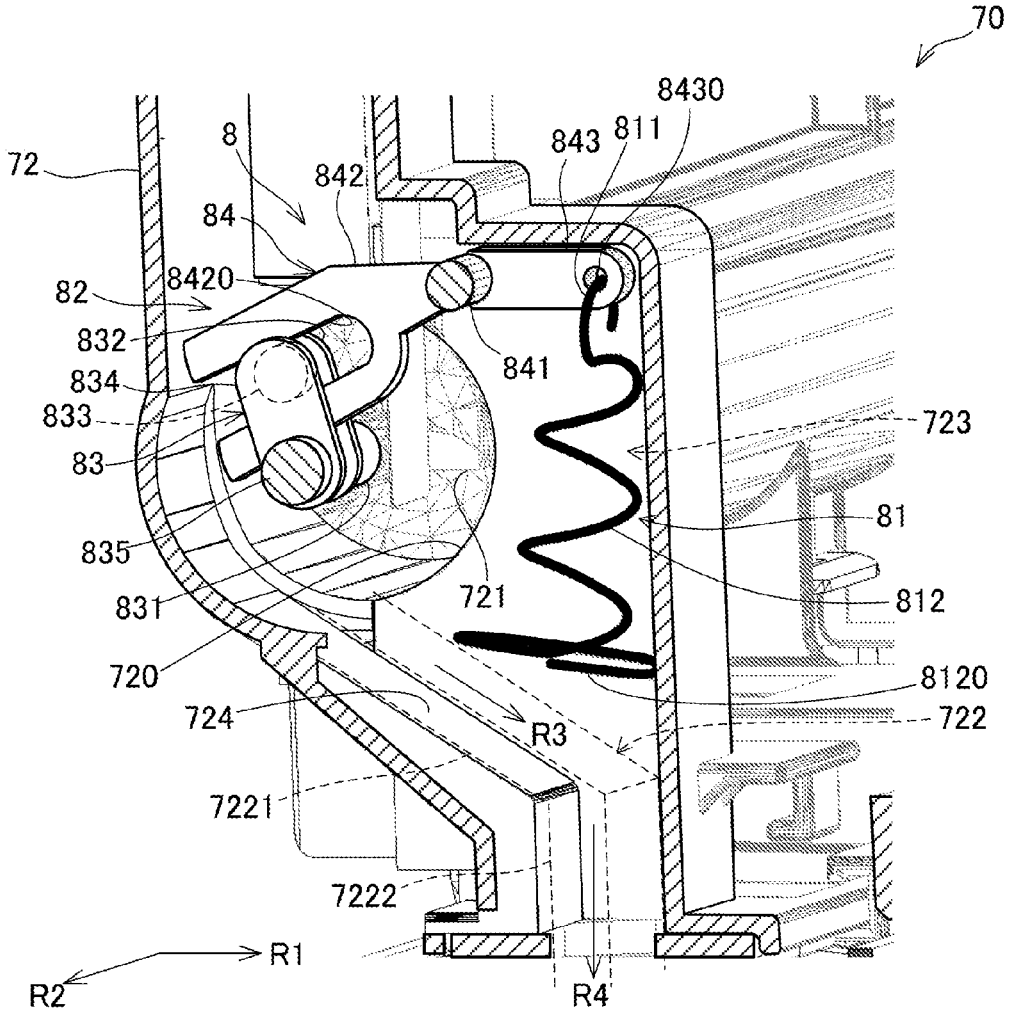
FIG. 7 is a perspective view of an accumulated developer breaking mechanism part in the waste developer discharge unit included in the image forming apparatus according to the embodiment.
Figure 8:
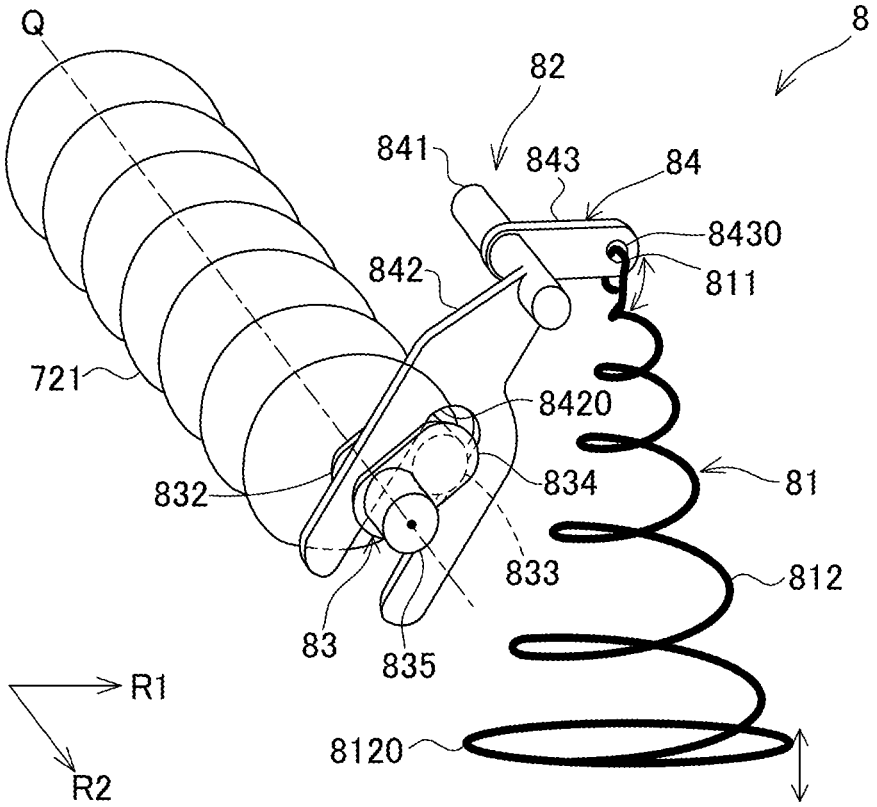
FIG. 8 is a perspective view of a second waste developer conveying member and the accumulated developer breaking mechanism included in the image forming apparatus according to the embodiment.

In the example shown in FIGS. 7 and 8, the drive mechanism 82 includes a crank portion 83 and a swing portion 84 which engages the crank portion 83 such that the swing portion 84 is swingable. The crank portion 83 includes a rotation shaft connection portion 831, a first flange portion 832, a rotation portion 833, a second flange portion 834, and a first support shaft portion 835.

The rotation shaft connection portion 831 and the first flange portion 832 are connected to each other, the rotation portion 833 is connected to the first flange portion 832 and the second flange portion 834, and the second flange portion 834 is connected to the first support shaft portion 835. The rotation portion 833 connects the first flange portion 832 and the second flange portion 834 to each other such that the first flange portion 832 and the second flange portion 834 are spaced apart from each other.

The rotation shaft connection portion 831 is connected to the rotation shaft portion of the second lateral conveying member 721. The rotation shaft portion of the second lateral conveying member 721, the rotation shaft connection portion 831, and the first support shaft portion 835 are formed along a rotation center line Q of the second lateral conveying member 721. The first support shaft portion 835 is supported by a shaft support portion which rotatably supports the second lateral conveying member 721 and is not shown. The shaft support portion is a part of the second casing 72.

Meanwhile, the swing portion 84 includes a second support shaft portion 841, a first arm portion 842, and a second arm portion 843. The second support shaft portion 841 is rotatably supported by a part of the second casing 72.

The first arm portion 842 and the second arm portion 843 are formed so as to project from the second support shaft portion 841 in different directions, respectively. The first arm portion 842 has an engagement portion 8420 formed so as to engage the rotation portion 833 of the crank portion 83. The engagement portion 8420 is inserted between the first flange portion 832 and the second flange portion 834 of the crank portion 83.

In the example shown in FIGS. 7 and 8, the engagement portion 8420 is a cut portion in which the rotation portion 833 is inserted in a slidable state. The support portion 8430 to which the supported portion 811 of the displacement member 81 is connected is formed in the second arm portion 843.

When the second lateral conveying member 721 rotates, the rotation portion 833 rotates around the rotation center line Q of the second lateral conveying member 721. When the rotation portion 833 rotates, the engagement portion 8420 of the first arm portion 842 which engages the rotation portion 833 is displaced so as to be reciprocated along a circular arc having a center at the second support shaft portion 841. In addition, the support portion 8430 of the second arm portion 843 is displaced so as to be reciprocated in the up-down direction in conjunction with the movement of the first arm portion 842. As a result, the displacement member 81 is displaced so as to be reciprocated between the first position and the second position.

The displacement member 81 and the drive mechanism 82 are housed within the second casing 72 which forms therein the movement path which includes the fall path 722. In this case, even when the drive mechanism 82 is provided, no gap which leads to the outside of the second casing 72 occurs in the movement path of the waste developer 900 and a peripheral area thereof. Thus, the drive mechanism 82 becoming a cause for scatter of the waste developer 900 is avoided.

[Application Examples]

In the image forming apparatus 10 described above, the drive mechanism 82 may be composed of a mechanism other than the link mechanism which includes the crank portion 83 and the swing portion 84. For example, the drive mechanism 82 may be a mechanism which includes a cam mechanism.

In the image forming apparatus 10, the accumulated developer breaking mechanism 8 may be provided in a movement path for the developer 90 which extends from each developer supply portion 40 to the corresponding image forming portion 4.

The image forming apparatus according to the present disclosure can be configured by freely combining the embodiments and application examples described above, or modifying or partially omitting the embodiments and the application examples as appropriate, within the scope of the invention recited in each claim.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a displacement member supported so as to be displaceable; and a drive mechanism configured to displace the displacement member between a first position away from a fall path of a movement path for a powdery developer and a second position at which at least a part of the displacement member enters the fall path, wherein the fall path includes an inclined slide path on an inclined surface and a vertical fall path which is connected to a lower portion of the inclined slide path and formed along a vertical direction, the drive mechanism displaces the displacement member between the first position and the second position at which a part of the displacement member is located in a range from the inclined slide path to the vertical fall path, the displacement member is supported by a support portion of the drive mechanism in a suspended state, and includes a large-diameter portion which is formed at a lower end with a larger contour than an upper supported portion supported by the support portion, and the drive mechanism displaces the displacement member between the first position at which the large-diameter portion is away upward from the fall path and the second position at which the large-diameter portion is located in an inclined state in the range from the inclined slide path to the vertical fall path.

2. The image forming apparatus according to claim 1, further comprising a lateral conveying member configured to convey the developer in a lateral direction by rotating within a lateral movement path which is connected to an upper portion of the fall path of the movement path and formed along the lateral direction, wherein the drive mechanism is a link mechanism configured to convert a rotating motion of the lateral conveying member to a reciprocating motion of a support portion connected to the displacement member.

3. The image forming apparatus according to claim 2, wherein the displacement member and the drive mechanism are housed in a casing which forms therein the movement path.

4. The image forming apparatus according to claim 2, wherein the link mechanism includes:

a crank portion connected to the lateral conveying member; and a swing portion connected to the displacement member and configured to engage the crank portion such that the swing portion is swingable.

5. The image forming apparatus according to claim 1, wherein the displacement member includes a helical portion which is formed in a helical shape and elastically deformable.

6. The image forming apparatus according to claim 1, wherein the displacement member and the drive mechanism are housed in a casing which forms therein the movement path which includes the fall path.

7. The image forming apparatus according to claim 1, wherein the movement path for the developer which movement path includes the fall path is a movement path for used developer which movement path extends from an image forming portion configured to form an image by using the developer to a waste developer storage portion.

8. An image forming apparatus comprising:

a displacement member supported so as to be displaceable; and a drive mechanism configured to displace the displacement member between a first position away from a fall path of a movement path for a powdery developer and a second position at which at least a part of the displacement member enters the fall path, a lateral conveying member configured to convey the developer in a lateral direction by rotating within a lateral movement path which is connected to an upper portion of the fall path of the movement path and formed along the lateral direction, wherein the fall path includes an inclined slide path on an inclined surface and a vertical fall path which is connected to a lower portion of the inclined slide path and formed along a vertical direction, the drive mechanism displaces the displacement member between the first position and the second position at which a part of the displacement member is located in a range from the inclined slide path to the vertical fall path, the drive mechanism is a link mechanism configured to convert a rotating motion of the lateral conveying member to a reciprocating motion of a support portion connected to the displacement member, the link mechanism includes:

a crank portion connected to the lateral conveying member; and a swing portion connected to the displacement member and configured to engage the crank portion such that the swing portion is swingable, the crank portion includes:

a rotation shaft connection portion connected to a rotation shaft portion of the lateral conveying member;

a first flange portion connected to the rotation shaft connection portion;

a rotation portion connected to the first flange portion; and a second flange portion connected to the rotation portion, the rotation portion connects the first flange portion and the second flange portion to each other such that the first flange portion and the second flange portion are spaced apart from each other, and a part of the swing portion is inserted between the first flange portion and the second flange portion to engage the rotation portion.

9. The image forming apparatus according to claim 8, wherein the crank portion includes a first support shaft portion supported by a shaft support portion formed along a rotation center line of the lateral conveying member, the second flange portion is connected to the first support shaft portion, and the lateral conveying member is rotatably supported by the shaft support portion.

10. The image forming apparatus according to claim 9, wherein the shaft support portion is a part of a casing which houses the lateral conveying member.

11. The image forming apparatus according to claim 8, wherein the swing portion includes:

a second support shaft portion supported rotatably; and a first arm portion and a second arm portion formed so as to project from the second support shaft portion in different directions, respectively, an engagement portion inserted between the first flange portion and the second flange portion to engage the rotation portion is formed in the first arm portion, a support portion configured to support the displacement member in a suspended state is formed in the second arm portion, and when the lateral conveying member rotates, the rotation portion rotates, further the engagement portion engaging the rotation portion is displaced so as to be reciprocated, and further the support portion of the second arm portion is displaced so as to be reciprocated in an up-down direction, thereby displacing the displacement member such that the displacement member is reciprocated between the first position and the second position.

12. The image forming apparatus according to claim 11, wherein the engagement portion is a cut portion in which the rotation portion is inserted in a slidable state.

* * * * *